US006257349B1

(12) United States Patent
Bardwell

(10) Patent No.: US 6,257,349 B1
(45) Date of Patent: Jul. 10, 2001

(54) TOP HEAD DRIVE AND MAST ASSEMBLY FOR DRILL RIGS

(76) Inventor: Allen Eugene Bardwell, 900 Shenandoah Shores Rd., Front Royal, VA (US) 22630

( * ) Notice: Subject to any disclaimer, the term of this patent is extended or adjusted under 35 U.S.C. 154(b) by 0 days.

(21) Appl. No.: 09/680,452

(22) Filed: Oct. 6, 2000

(51) Int. Cl.[7] ..... E21B 15/00; E21B 19/00

(52) U.S. Cl. ..... 173/28; 173/147; 173/184; 175/85; 175/122

(58) Field of Search ..... 173/27, 28, 184, 173/185, 191, 189, 42, 39, 152, 147; 175/85, 170, 57, 122

(56) References Cited

U.S. PATENT DOCUMENTS 3,026,949 * 3/1962 Eldridge et al. ..... 173/28
3,529,679 * 9/1970 Leven ..... 173/28
3,645,343 * 2/1972 Mays ..... 173/147
3,867,989 * 2/1975 Hisey et al. ..... 173/147
3,994,350 * 11/1976 Smith et al. .
4,421,179 * 12/1983 Boyadjieff .
4,589,503 * 5/1986 Johnson et al. .
4,800,968 * 1/1989 Shaw et al. .
4,938,296 * 7/1990 Brazell, II ..... 173/28
5,038,871 * 8/1991 Dinsdale .
5,090,486 * 2/1992 Jones ..... 173/28
5,107,940 * 4/1992 Berry .
5,222,564 * 6/1993 Bonca ..... 173/27
5,501,286 * 3/1996 Berry .
5,647,442 * 7/1997 Lange ..... 173/184
5,794,723 * 8/1998 Caneer, Jr. et al. .

* cited by examiner

*Primary Examiner*—Scott A. Smith
(74) *Attorney, Agent, or Firm*—Dowell & Dowell, P.C.

(57) ABSTRACT

A top head rotary drive and mast assembly for drilling which is adapted to be readily mounted on a derrick of a conventional truck, crawler or other vehicle so as to be movable from a stored position adjacent the derrick to a deployed position spaced from the derrick for drilling. The mast is adapted to be pivotally connected by at least one upper support arm to the derrick of the vehicle. The deployment and retraction of the mast and the top head rotary drive relative to the derrick are accomplished utilizing either a control device for moving a holding plate which is movable along the mast and to which the top head rotary drive is mounted or by separate lifting device. The invention is also directed to a combination top head drive and mast assembly and drilling rig and method for their use.

22 Claims, 8 Drawing Sheets

58
60
93
48
47
32
33
30
23
120
34
20
140

41
142
143
42
40
29
200
22
45
73
P1
P2
72
24
58
56
26
25
26
25

32
30
100
98
23
120
82
140
140
29
143
142
22
43B
40
45
102
103
20
90
101
132
110
58
130
135
134

32
30
32
23
40
120
122
121
140
S
140
20
22
135
132
130
134

TOP HEAD DRIVE AND MAST ASSEMBLY FOR DRILL RIGS

BACKGROUND OF THE INVENTION

1. Field of the Invention

This invention is generally directed to drilling rigs used for creating wells or blast holes and more particularly to a top head drive and mast assembly which is adapted to be mounted to a conventional mast or derrick of a drill rig such that the drill rig can operate with a rotary top head drive. In a preferred embodiment, the invention will be described as being mounted to a conventional cable drilling rig wherein the top head rotary drive may be easily moved into position for rotary drilling and stabilized in position for advancing a drill string. The top head rotary drive and mast assembly can easily be raised and moved into close proximity with an existing mast or derrick, such as a derrick of cable drill rig, such that the top head rotary drive and mast are out of alignment with a drill hole thus allowing conventional drilling equipment to be fully operational.

2. Brief Discussion of the Related Art

In the boring or drilling of wells or blast holes and the placing of well casing or lining, generally two types of drilling rigs are used. A first rig, known as a cable drill rig, operates using a bit and drill stem which is raised and lowered for impact by a cable system.

As opposed to the reciprocal driving movement created by a cable rig, other rigs, known as rotary air rigs, provide rotation and compressed air through a drill string for drilling. Generally, such rotary air rigs are more efficient in generating greater drilling speeds for drilling wells in a more expeditious manner.

Conventional rotary air rigs incorporate a drill table mounted along a base of a mast. The rotary table includes a drive motor. In order to drill utilizing a rotary table, a kelly system is required wherein a kelly rod is connected to each section of drill pipe as the drill string is lowered. Because of the requirement for the drive kelly to engage within a chuck of the rotary drive head, a significant amount of time and labor is required when adding or removing a pipe section to a drill string as the kelly must be removed from the uppermost drill pipe section during each step.

To overcome the deficiencies of rotary table drive systems, newer top head rotary drive systems have been developed. Top head drive systems include a rotary drive head driven by one or more motors. The rotary drive heads are guided in a vertically reciprocating motion along rails of masts of such systems. Various types of assemblies may be utilized to raise and lower the top head rotary units during use. The benefit of the direct or top head rotary drive system is that the kelly bar required for drive tables is not necessary and the top head rotary drives may be connected directly, or through a coupling member, to an uppermost pipe section of a drill string.

It is preferred that the top head air rotary drive be used when retrieving and or replacing sections of a drill string for purposes of replacing a drill bit, such as in a sequence of tripping out sections of a drill string to replace a drill bit and tripping in pipe sections to reform the drill string.

In view of the foregoing, there remains a need to adapt vehicles having derricks, including conventional cable drilling rigs, such that they may operate with top head rotary drives which may be easily moved into a drilling position to facilitate the expeditious drilling of a bore or well hole and yet can be easily moved out of alignment position with the hole to permit the use of other equipment such as conventional cable equipment.

Some examples of prior art top head rotary drive drill systems are disclosed in the U.S. Pat. No. 3,994,350 to Smith et al., U.S. Pat. No. 4,421,179 to Boyadjieff, U.S. Pat. No. 4,589,503 to Johnson et al., U.S. Pat. No. 4,800,968 to Shaw et al., U.S. Pat. No. 5,038,871 to Dinsdale, U.S. Pat. No. 5,107,941 to Berry, U.S. Pat. No. 5,501,286 to Berry, and U.S. Pat. No. 5,794,723 to Caneer, Jr. et al.

SUMMARY OF THE INVENTION

A top head rotary drive and mast assembly for use with a vehicle or equipment having an elevatable mast or derrick such as a conventional cable drilling rig wherein the assembly includes a rotary air drive head which is mounted to a holding plate which is movable along a mast by being drivingly connected to a control device for raising and lowering the holding plate relative to the mast. In a preferred embodiment, the control device is a hydraulic piston which includes a rod having a rotary device, such as double pulley, mounted thereto about which extend cables or similar elements, one of which extends over an upper pulley at the crown of the mast downwardly to a point of connection with the holding plate and another which extends beneath a lower rotary device or pulley mounted on the mast such that a remote end connects to a portion of the holding plate. Ends of the elements which are remote from the holding plate are anchored relative to the mast such that, as the piston associated with the hydraulic cylinder is moved in or out, the elements are correspondingly played in or played out to maintain constant tension on the holding plate to thereby ensure that the holding plate is stabilized with respect to the mast.

The rotary air drive head and mast assembly further includes at least one, and preferably two, support arms which extend outwardly from an upper portion thereof and which arms have free ends which are adapted to be pivotally connected to support the mast from a derrick of a conventional truck or crawler. To stabilize the mast when mounted to the derrick of such conventional equipment, the assembly further includes at least one, and preferably two, upwardly inclined stabilizer arms which are connected to a lower portion of the mast and extend upwardly at an angle of between approximately 30° to 45° to outer ends which are adapted to be secured to the frame of the conventional vehicle. In a preferred embodiment, a further stabilizer arm is provided which is connected at one end to the lower portion of the mast in vertically spaced relationship with respect to the inclined stabilizer arms and which includes an outer or free end which is adapted to be connected to the frame of the conventional vehicle, such as a conventional cable drill rig. This additional stabilizer arm is inclined at an angle which varies from the angle of inclination of the inclined stabilizer arms and preferably, the additional stabilizer arm is oriented generally perpendicular with respect to a point of attachment on the mast and frame of the rig.

In one preferred embodiment, the top head air rotary drive and mast assembly includes at least one, and preferably two, restraint elements which are adapted to be connected at opposite sides of the holding plate and extend vertically upwardly therefrom to points of connection on the derrick of the conventional cable or other rig. In some embodiments, the restraint elements are cables having looped lower ends which are adapted to be mounted over hooks provided on the holding plate. The restraint elements create a re-direction of force from the control device which normally moves the holding plate in reciprocating motion along the mast. When the restraint elements are in place, should the control device be activated to move the holding plate toward the lower portion of the mast, the restraint elements will prevent such movement thereby causing the connections between the control device and the holding plate to supply a lifting force on the mast when the mast has been connected by the upper support arms to the derrick of the conventional drill rig and the stabilizing arms disconnected from the derrick of the conventional rig. As the mast elevates, it will pivot about the upper support arms and will be drawn into close proximity abutting the derrick. The mast is thereafter retained in the raised position by the control device. In the preferred embodiment, the control device is a hydraulic cylinder such that hydraulic pressure is utilized to retain the mast in an elevated position.

In another embodiment, the lowering and raising of the top head air rotary drive and mast assembly to and from a deployed position relative to a conventional derrick is accomplished using a winch type device mounted to the mast or by a cable extending to a winch device mounted to the rig on which the derrick is supported.

The top head air rotary drive and mast assembly further includes a guide table mounted to the lower portion of the mast having an opening therein through which the drill string extends. In a preferred embodiment, a section of the table may be pivoted away from a main portion of the table thereby allowing lateral access to the guide opening therethrough. A holding and break out wrench is further provided and pivotally supported adjacent the lower portion of the mast for use in supporting drill string pipe sections and for making and breaking connections between drill pipe sections and between the rotary drive head and a section of drill pipe.

An appropriate anchor element is secured or mounted to the guide table for purposes of allowing a cable, such as a cable of a cable drill rig, to be secured thereto for facilitating lowering of the mast to a drilling position.

It is the primary object of the present invention to provide a top head or direct air rotary drive and mast assembly which can be easily mounted to a derrick or mast of a conventional drill rig, truck, crawler or other vehicle, to thereby adapt such vehicle to be used for direct air drive rotary drilling.

It is also an object of one embodiment of the present invention to provide a top head air rotary drive and mast assembly which includes a holding plate for the top head rotary unit which plate is guidely mounted to the mast and connected to a control device such that, when the assembly is mounted to a conventional derrick and restraint elements are secured between the holding plate and such derrick, the operation of the control device can be used to efficiently raise and lower, under its own weight, the mast relative to the derrick to thereby deploy the assembly to an aligned position to drill or bore a well hole or raise the assembly to a stored position adjacent the derrick to thereby permit the use of other equipment such as conventional cable equipment.

It is yet a further object of the present invention to provide a top head air rotary drive and mast assembly for use with conventional drilling rigs wherein the assembly is stabilized to counter torque generated by the top head air rotary drive when drilling by the use of stabilizer arms which are selectively mounted to the lower portion of the mast of the assembly and the frames of the conventional drill rigs.

BRIEF DESCRIPTION OF THE DRAWINGS

A better understanding of the invention will be had with respect to the following specification and with reference to the attached drawings. In this respect, the invention, in the preferred embodiment shown, is mounted to a conventional cable drill rig, however, the invention may be used with other vehicles including trucks or crawlers having masts or derricks. In the drawings.

DESCRIPTION OF THE PREFERRED EMBODIMENTS

Figure 1:
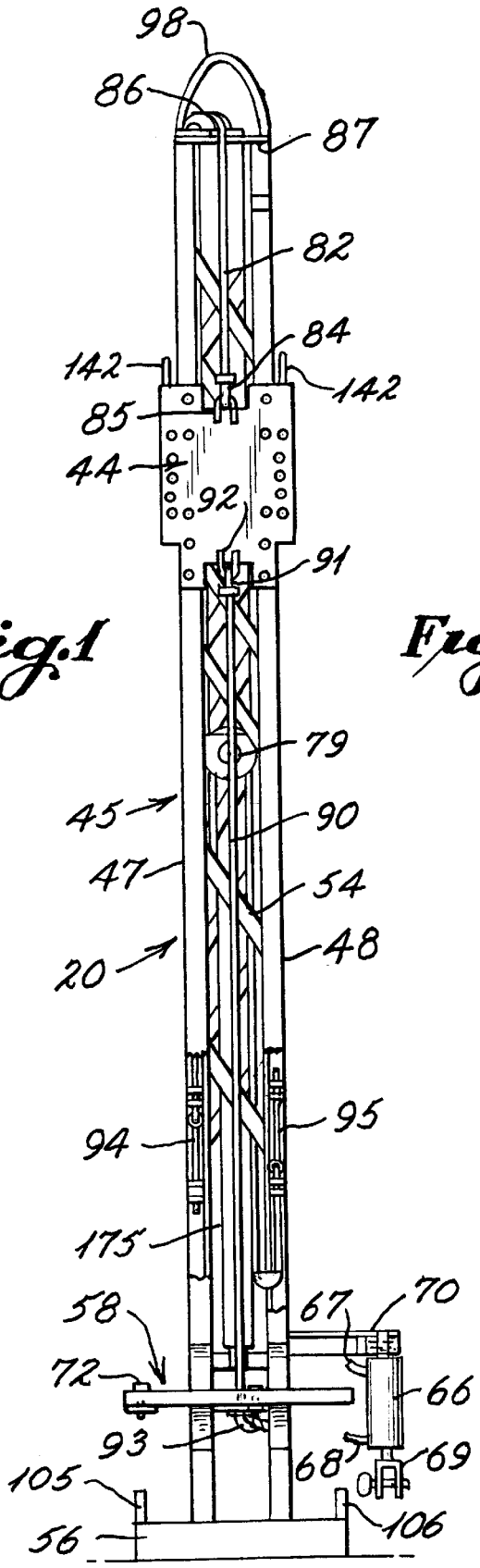
FIG. 1 is a front elevational view of the top head rotary drive and mast assembly of the present invention having the top head rotary drive detached and having portions broken away.
Figure 2:
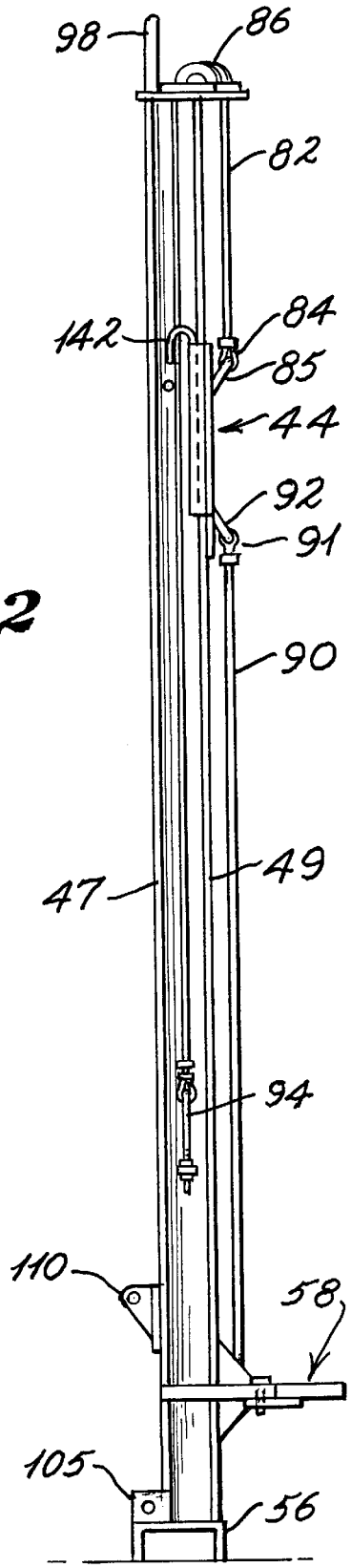
FIG. 2 is a view of the assembly of FIG. 1 taken from the right side.

With continued reference to the drawings, the top head air rotary drive and mast assembly 20 of the present invention is shown mounted to a conventional cable drilling rig 22 having a derrick 23. The invention, however, may be used with other vehicles, including trucks and crawlers, having a mast or derrick mounted thereto.

As illustrated in FIGS. 10–15, the drilling rig includes a frame 24 mounted to support wheels 25. To stabilize the rig for drilling, four hydraulic jacks 26 are provided each have an extensible foot for engaging a surface to thereby stabilize the vehicle and prevent rocking or tilting of the vehicle when the derrick 23 is raised and during drilling. The derrick may include a base section 28 which is pivotally mounted at 29 adjacent the rear of the rig and from which extends an extendable section 30 having a block or pulley assembly 32 mounted thereto over which an operating cable 33 of the rig extends. The cable is connected to a hoist or winding drum (not shown) mounted on the chassis of the drill rig and reinforcing 34 is shown in dotted line in the drawings for supporting the derrick when raised.

Figures 9, 11:
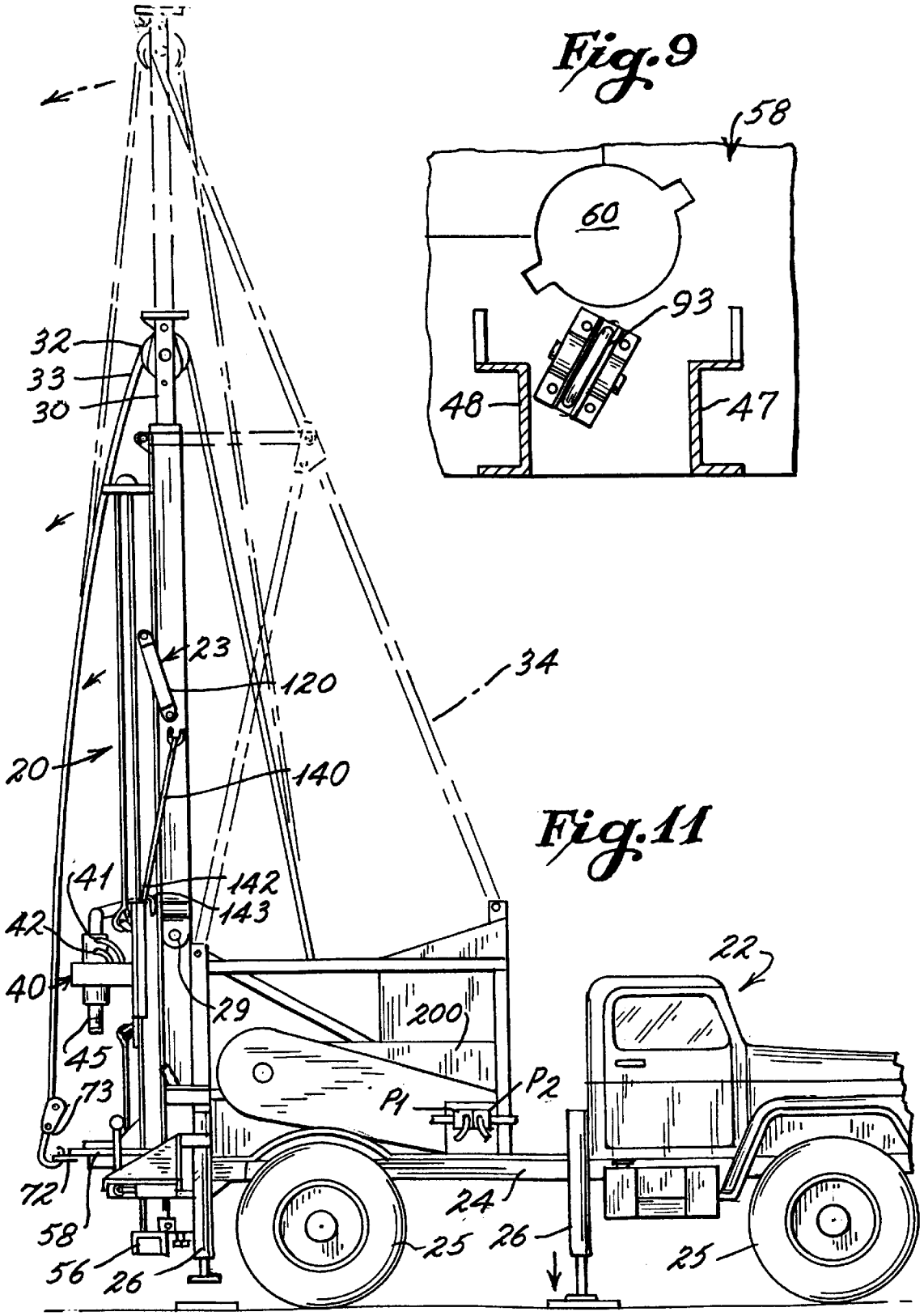
FIG. 9 is a cross sectional view taken along line 9—9 of FIG. 3.
FIG. 11 is an illustrational view similar to FIG. 10 showing the top head rotary drive and mast assembly of the invention mounted to a derrick of the conventional cable drill rig with the derrick raised to a vertically elevated position with the assembly of the present invention being elevated and drawn into abutting relationship thereto.

As clearly shown in FIG. 11, the derrick of the cable rig is inclined from the vertical at approximately 1 to 1½ degrees such that the drill cable 33 falls free of the rear of the derrick during use. With a derrick height of 36 to 38 feet, the bore hole for any drill string being supported by the derrick would be approximately 28 to 36 inches from the base of the derrick spaced rearwardly from the drill rig. In this regard, one of the benefits of the present invention is that it allows the top head rotary drive and mast assembly to be pivotally mounted to the derrick in such manner that the assembly may be used for drilling by being deployed outwardly relative to the base of the derrick and generally in line with the upper portion of the derrick so that any drill hole created by the assembly will be properly aligned with the drill cable 33 of the drill rig. In this manner, the drilling of the hole may be accomplished using the present invention and, thereafter, the assembly raised to a position in close proximity to the derrick, as is shown in FIG. 11, wherein the cables of the cable drill rig may be used for drilling or placing well casing. The addition of the assembly to a conventional cable rig greatly enhances the utility of the cable rig and also allows conventional use of the cable rig for those operations which are more suitably performed by the components of the cable rig.

Figure 5:
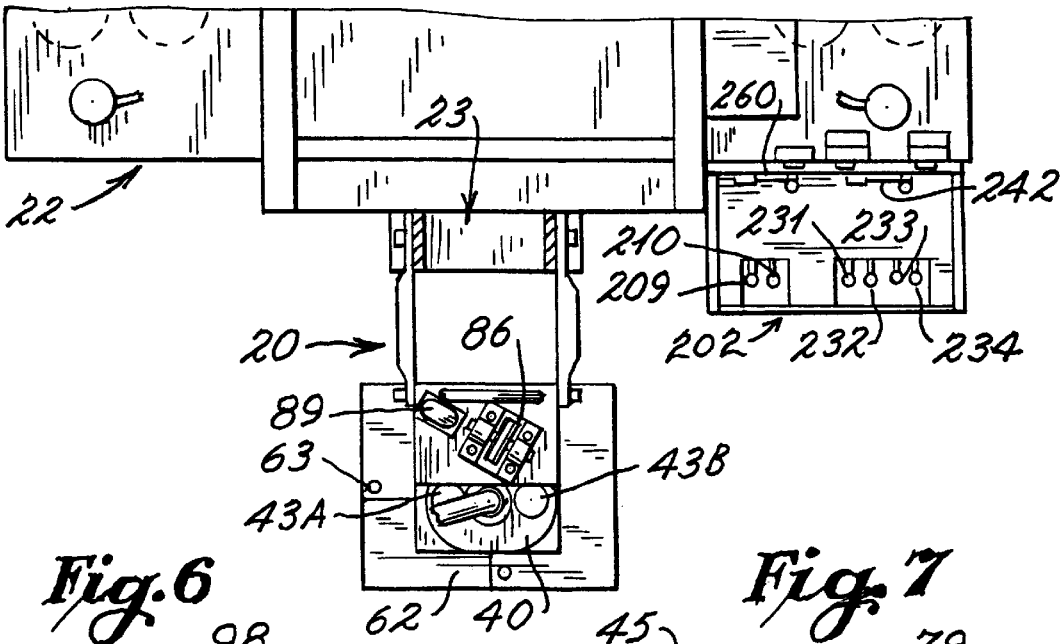
FIG. 5 is a cross sectional view taken along line 5—5 of FIG. 13 showing the assembly of FIG. 1 mounted to a derrick of a cable drill rig and showing the control panel for the hydraulics of the preferred embodiment of the present invention.
Figure 6:
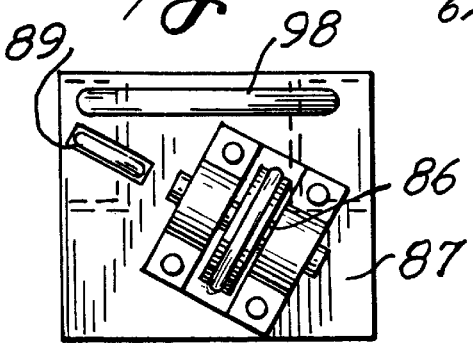
FIG. 6 is a top plan view taken along line 6—6 of FIG. 3.
Figure 16:
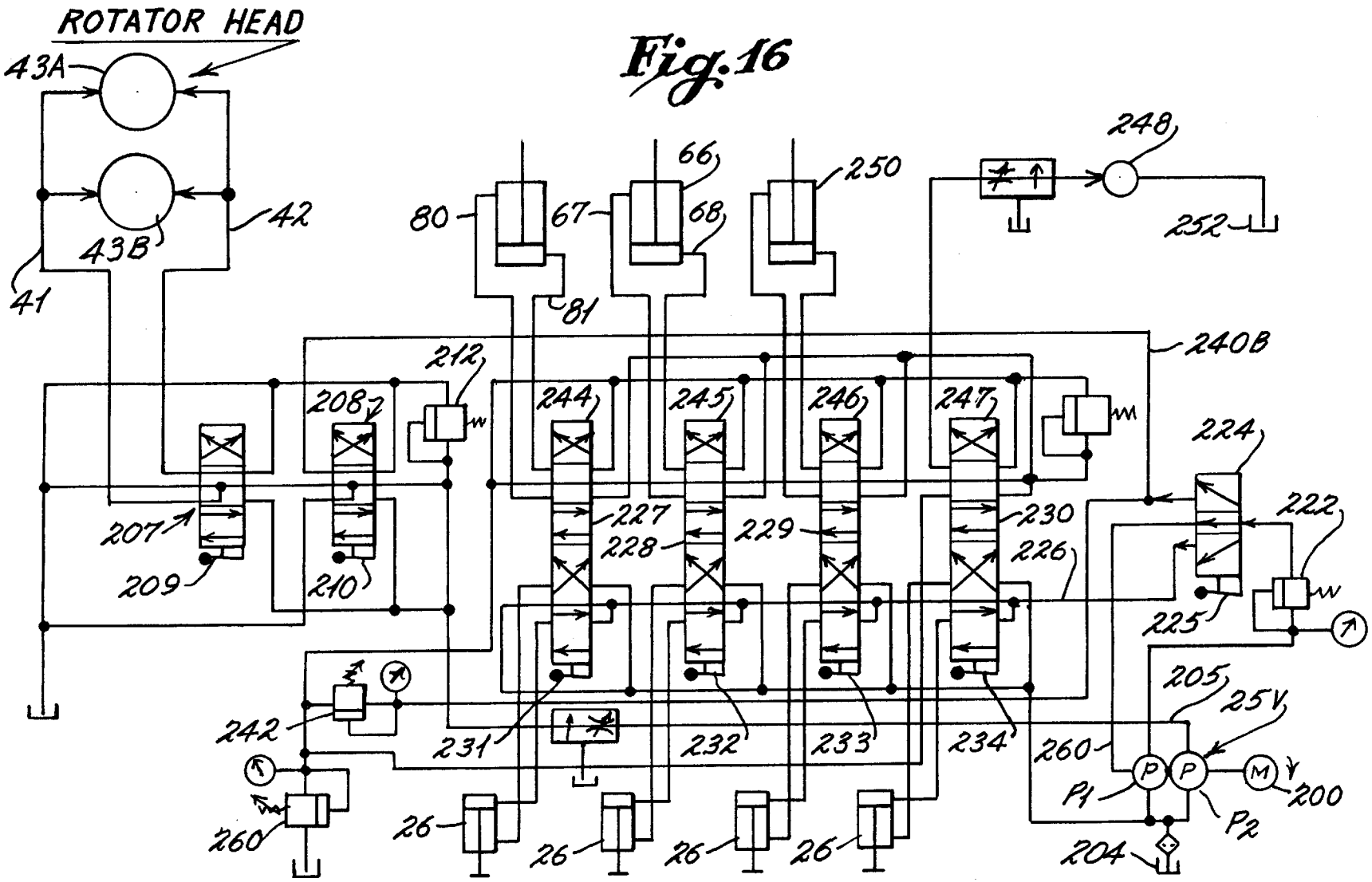
FIG. 16 is a circuit diagram for controlling the hydraulic components of the present invention.

The top head rotary drive 40 includes one or more drive motors 43A and 43B, see FIGS. 5 and 16, which, in the preferred embodiment, are hydraulic motors which are connected by hydraulic lines 41 and 42, see FIGS. 11 and 16, to a source of hydraulic pressure. The top head rotary drive 40 is carried by a holding plate 44 by being bolted or otherwise secured thereto. The top head rotary drive includes an output drive connection or coupler 45 which is designed to be engageable with a section "S" of drill pipe, as shown in FIG. 13.

Figure 7:
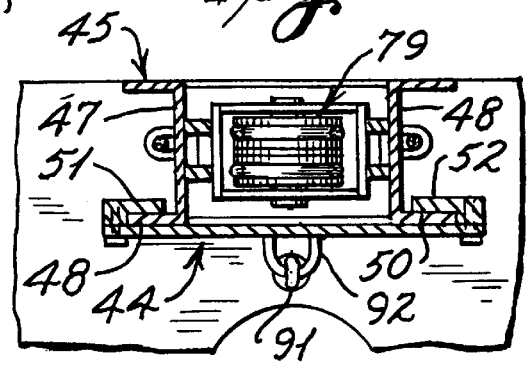
FIG. 7 is a cross sectional view taken along line 7—7 of FIG. 3.

The holding plate 44 is mounted to a mast 45 having oppositely oriented generally C-shaped vertically extending columns 47 and 48 which define a pair of elongated guide flanges 49 and 50, respectively. The holding plate 44 includes rearwardly extending generally L-shaped flanges 51 and 52, see FIG. 7, which are spaced so as to guidingly engage the holding plate 44 on opposite sides of the flanges 49 and 50 to thereby guide the holding plate in its vertical reciprocating motion along the length of the mast 45. The elongated C-shaped columns are reinforced by a plurality of cross bracing 54.

Figure 8:
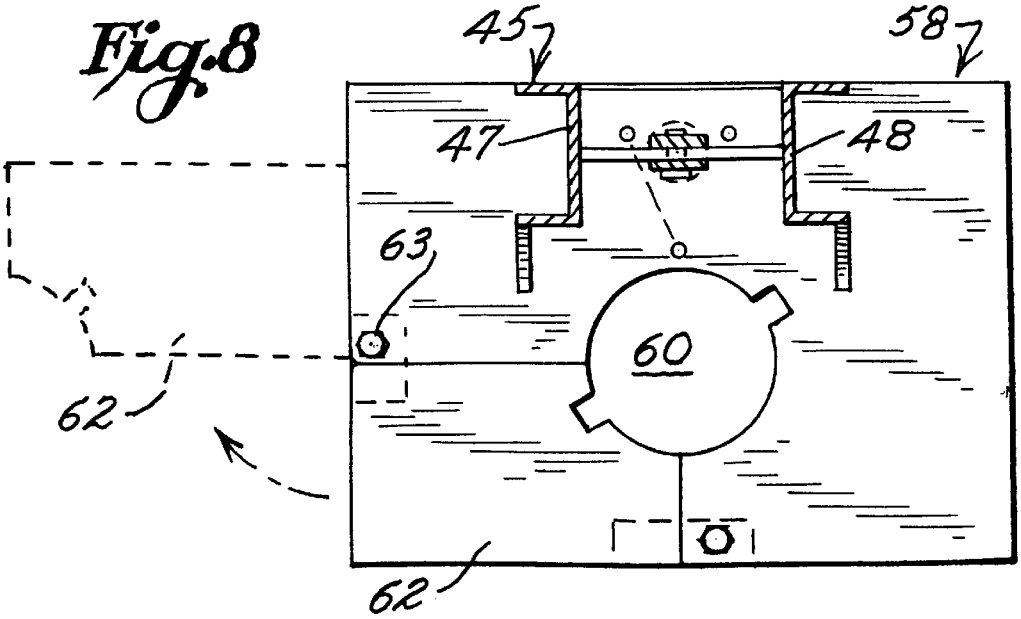
FIG. 8 is a cross sectional view taken along line 8—8 of FIG. 3 showing a portion of the guide table pivoted away from the guide opening in dotted line.
Figure 13:
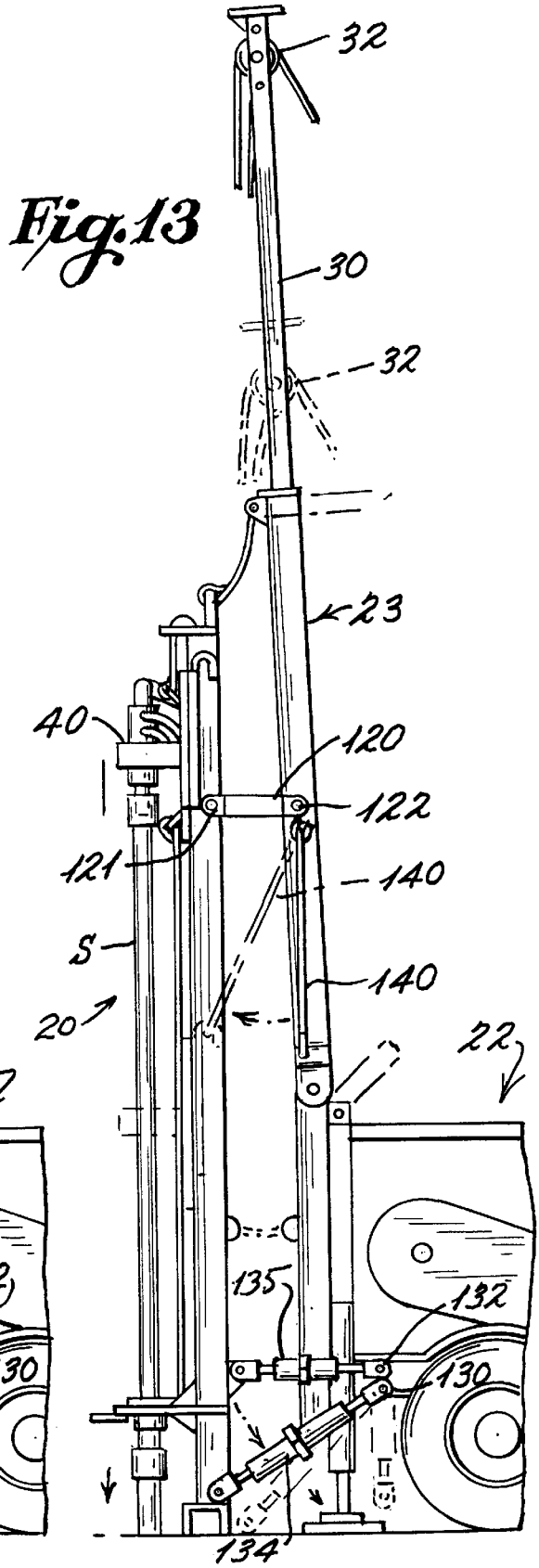
FIG. 13 is an illustrational view showing the assembly of the present invention as it is positioned for drilling, spaced from the derrick of the conventional cable rig, and showing the stabilizer arms of the invention being secured in place along the lower portion of the mast of the assembly.

The mast 45 further includes a base 56 used for initially stabilizing the mast when being lowered to a position for drilling, as is illustrated in FIG. 13. Spaced above the base is a guide table 58 having a guide opening 60. To facilitate the placement of some drilling tools on the end of the drill string, the guide table includes a section 62 that is pivotally mounted at 63 so as to pivot away from the opening 60, as is illustrated in dotted lines in FIG. 8. This allows unobstructed lateral access to the opening for the placement of tools or casing beneath the opening 60 in the guide table.

To facilitate the connecting and breaking of joints or couplings between drill pipe sections, and as shown in FIG. 1, the present invention also includes a hydraulic wrench 66 having hydraulic lines 67 and 68 associated therewith and which includes an outer jaw 69. The wrench is pivotally mounted on an arm 70 so as to be movable into alignment with the opening 60 in the guide table 58.

Figure 12:
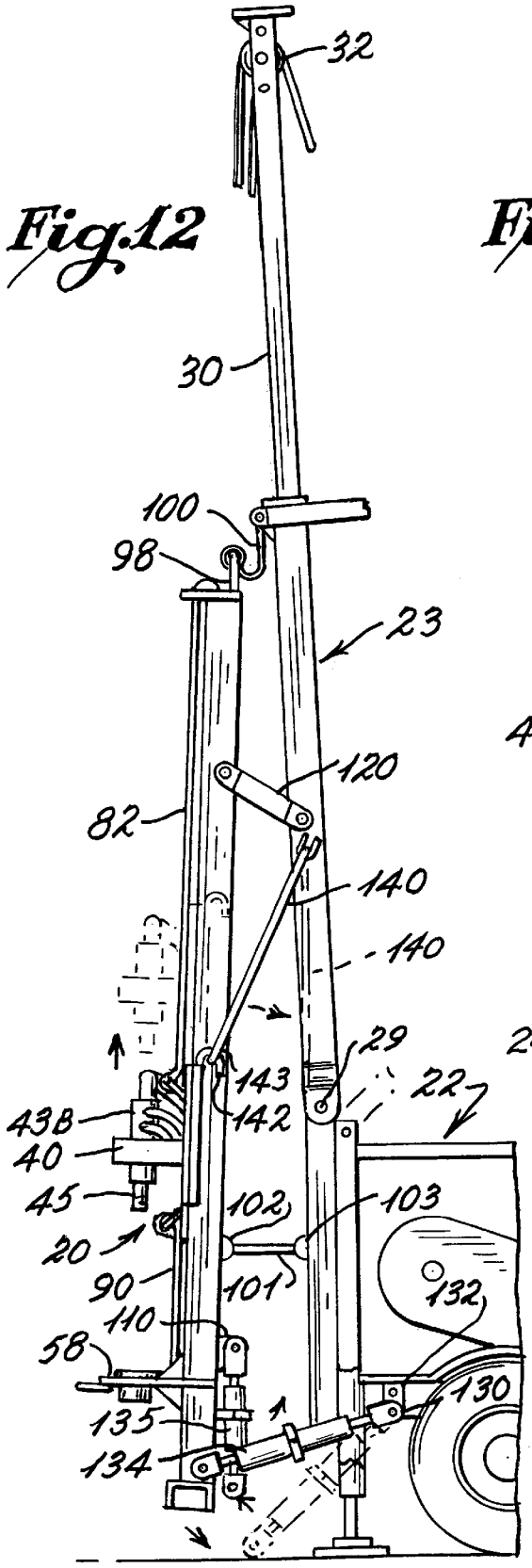
FIG. 12 is an illustrational view showing the assembly of the present invention as it is being initially lowered under its own weight toward a fully deployed position for drilling.

The guide table 58 is further provided with a retaining loop 72 for purposes of allowing attachment of a hook 73, see FIGS. 11 and 12, for purposes of facilitating the lowering of the assembly of the present invention to a deployed position, utilizing the conventional cable 33 of the cable rig 22.

Figure 3:
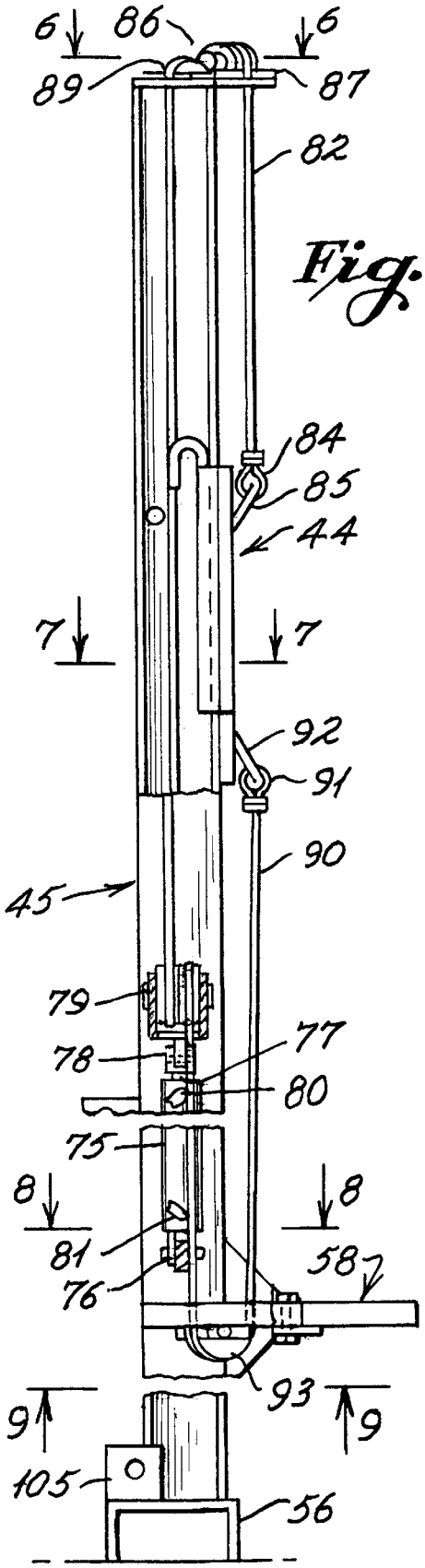
FIG. 3 is a view taken from the right side of the assembly of FIG. 1 having portions broken away to show the drive connection between the control device of the present invention and the holding plate which supports the top head rotary drive.
Figure 4:
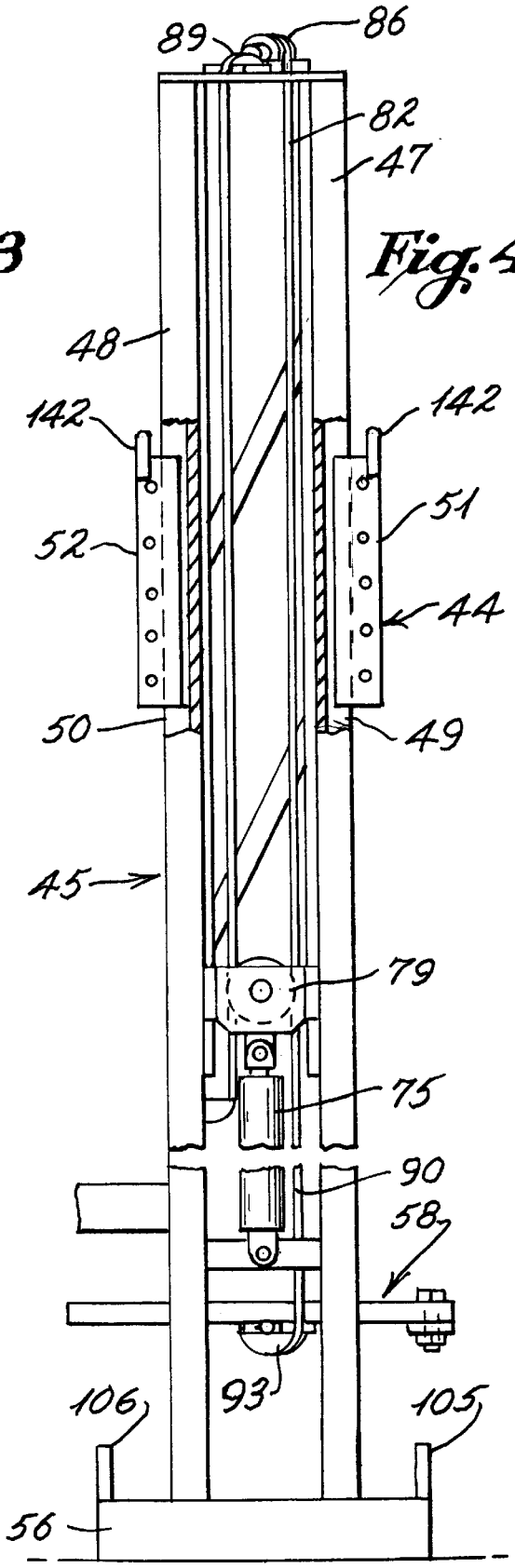
FIG. 4 is a rear elevational view having portions broken away of the assembly of FIG. 1.

The top head rotary drive and the mast assembly 20 further includes a control device 75 which is mounted to the mast 45 for controlling the reciprocal vertical movement of the holding plate 44 and thus the top head rotary drive 40 relative to the guide table 58. With reference to FIGS. 3 and 4, in the preferred embodiment, the control device includes a hydraulic cylinder having a base connected at 76 to the mast and having an extension rod 77 reciprocally mounted therein and which is connected at a yolk 78 to a double pulley or similar rotary guide member 79. Hydraulic fluid is conveyed to and from the hydraulic cylinder by way of an inlet and an outlet 80 and 81. It should be noted that other types of control devices, such as winches or electrical motors and the like, may be used and be within the teachings of the present invention.

The control device 75 is connected with the holding plate 44 by way of a first or upper cable or similar element 82. Other flexible and sturdy elements such as chains may be utilized to create the connection between the control device 75 and the holding plate 44. The element 82 is shown as having an outer end portion 84 secured to a connector 85 extending from an upper portion of the holding plate 44. From the outer end 84, the element extends over an upper rotary guide device or pulley 86 which is mounted at the crown 87 of the mast 45. From there, the element extends downwardly within the mast about the double pulley 79 and then upwardly to a guide pulley or rotary element 89 secured along the crown 87 of the mast and, thereafter, downwardly where the opposite end thereof is secured to an adjustable tensing device 94 which is secured to the mast.

The control device 75 is also connected by way of a lower cable or similar element 90 which is the same as element 82. The lower element is secured at its outer end 91 to an attachment element 92 secured to the holding plate 44. From the holding plate, the lower element extends over a lower guide pulley 93 mounted adjacent a lower portion of the mast and then upwardly about the double pulley 79 and from there to an adjustable tensing and anchoring device 95 which is secured to the mast.

From the foregoing description, it is noted that as the holding plate 44 is reciprocally moved by the control device 75, the cable or other elements 82 and 90 will maintain an equal tension on the upper and lower portions of the plate at the points of connection 85 and 92 thus stabilizing the plate relative to its position on the mast 45. Appropriate adjustment may be made to each element at the adjustable tensing devices 94 and 95.

Figure 14:
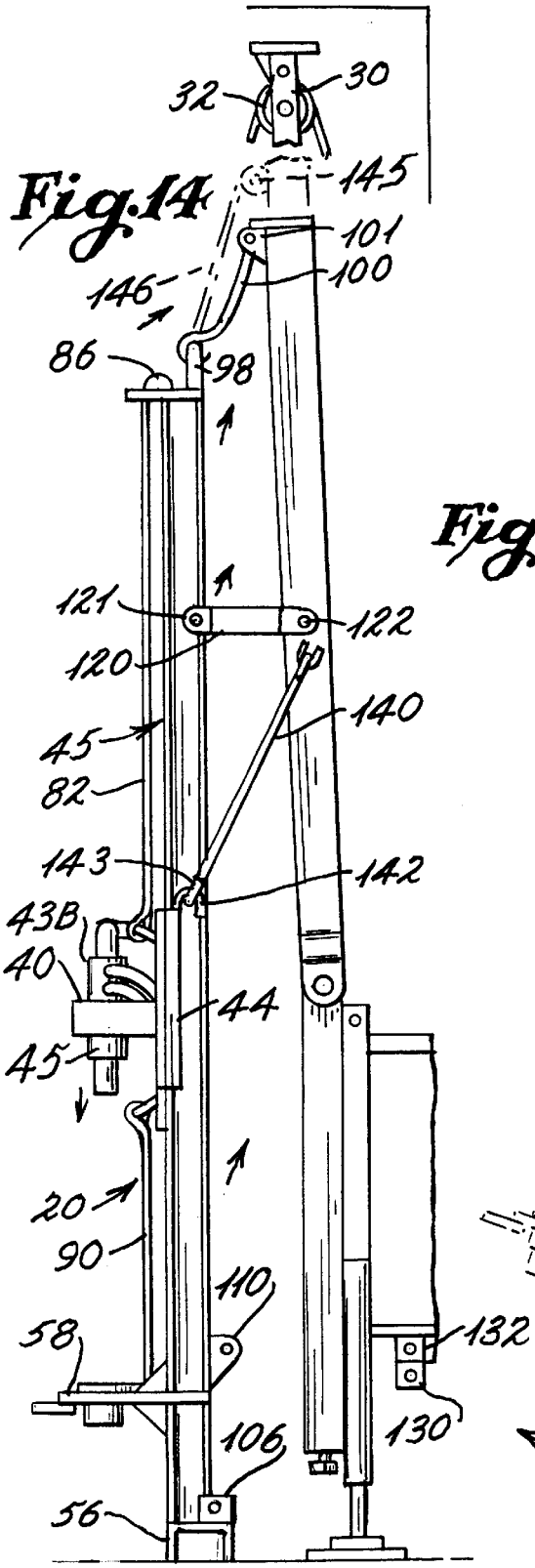
FIG. 14 is an illustrational view showing the initial raising of the assembly of the present invention relative to the derrick of the cable rig.

The mast 45 further includes an upper bail element 98 which is secured to and extends upwardly from the crown 87 thereof and which is used for the initial mounting of the mast relative to a conventional derrick and thereafter for purposes of securing a safety line or chain, such as shown in FIG. 14 at 100, which extends to a bracket 101 formed on the derrick 23.

With specific reference to FIGS. 1–4, the mast of the present invention also includes a pair of spaced mounting brackets 105 and 106 each having a central opening therein, as illustrated in FIG. 3, for purposes of receiving a locking pin or bolt for securing inclined stabilizer arms, as will be described hereafter. Also provided along the lower portion of the mast and along one of the elongated columns is a mounting bracket 110 having an opening therein for purposes of receiving a locking pin or bolt for securing a secondary stabilizer arm as will also be described.

The top head rotary drive and mast of the present invention is designed to be pivotally mounted to the conventional derrick 23. In this respect, the assembly includes a pair of upper support arms 120 which are pivotally mounted in parallel relationship with respect to one another at 121 to an upper portion of the mast and which are adapted to be pivotally mounted to the derrick at pivot points 122. The support arms are provided on each column 47 and 48 of the mast 45. The length of the support arms 120 is designed to allow the mast to be deployed to an appropriately spaced position rearwardly of the cable rig, as previously described, to permit drilling with the drilling hole being aligned with the upper portion of the derrick 23 so that cable tools of the conventional rig are appropriately aligned for use in a bore hole after the top head rotary drive and mast assembly is pivoted to an out-of-way or stored position.

To initially assemble the top head rotary drive and mast to the derrick 23 of the drill rig, the cable 33 of the drill rig is connected by way of the hook 73 to the bail 98 extending from the crown 87 of the mast. Thereafter, the mast is raised utilizing the controls associated with the cable rig. With the mast extended adjacent to the derrick, the mast is lowered until the support arms 120 are horizontal and generally perpendicular to the mast and to the derrick. Thereafter, a mark is made for the proper placement of brackets for providing the pivot points 122 on the derrick. After the brackets are attached, the support arms are secured to the derrick as previously described allowing a pivotal movement of the mast relative to the derrick.

The drill rig is further provided with a pair of spaced outer brackets 130 (only one being shown in FIGS. 12 and 13) which are vertically spaced so as to be above the brackets 105 and 106 associated with the base of the mast. Further, a second bracket 132 is provided on the frame of the drill rig which is designed to be generally aligned with the bracket 110 on the mast. With the mast being lowered to the position shown in FIG. 13, a first pair of inclined stabilizer arms 134 are secured between the brackets 105 and 106 and the brackets 130 of the drill rig. It should be noted that the stabilizer arms 134 are angled upwardly from the mast toward the drill rig. The orientation of the stabilizer members is provided so as to offset forces developed along the length of a drill string that might otherwise tend to lift the mast from the bore hole during drilling. To prevent any possible rotation of the stabilizer arms 134, an upper stabilizer arm 135 is mounted between the bracket 110 on the mast and the bracket 132 on the drill rig. As shown, the angle of the upper stabilizer arm is different than the angle of inclination of the inclined stabilizer arms 134. In the preferred embodiment, the orientation is such as to be generally perpendicular between the mast and the drill rig creating a rigid triangular structure, as is shown in FIG. 13, when the top head rotary drive motor is being used to advance a drill string. The stabilizer arms 134 and 135 are preferably "Patterson" turnbuckles thereby allowing flexibility in length adjustment. The stabilizers are preferably mounted utilizing removable pins to the brackets to which they are supported thereby allowing quick removal of the stabilizer arms when it becomes necessary to elevate or move the top head rotary drive and mast assembly to the stored position, as such movement would not be possible with the stabilizer arms in place.

It should be noted, that although two upper support arms have been described with respect to the preferred embodiment, it is possible, in some instances, that a single support arm could be used especially if the support arm includes a yolk type outer end. It is the specific purpose of the support arms to provide stability and, therefore, the two support arms shown in the drawing figures are preferred. In a like manner, it is possible that only a single stabilizer arm 134 may be used and be within the teachings of the present invention although providing stabilizer arms on either side of the mast is preferred, as is shown in the drawing figures.

Figure 15:
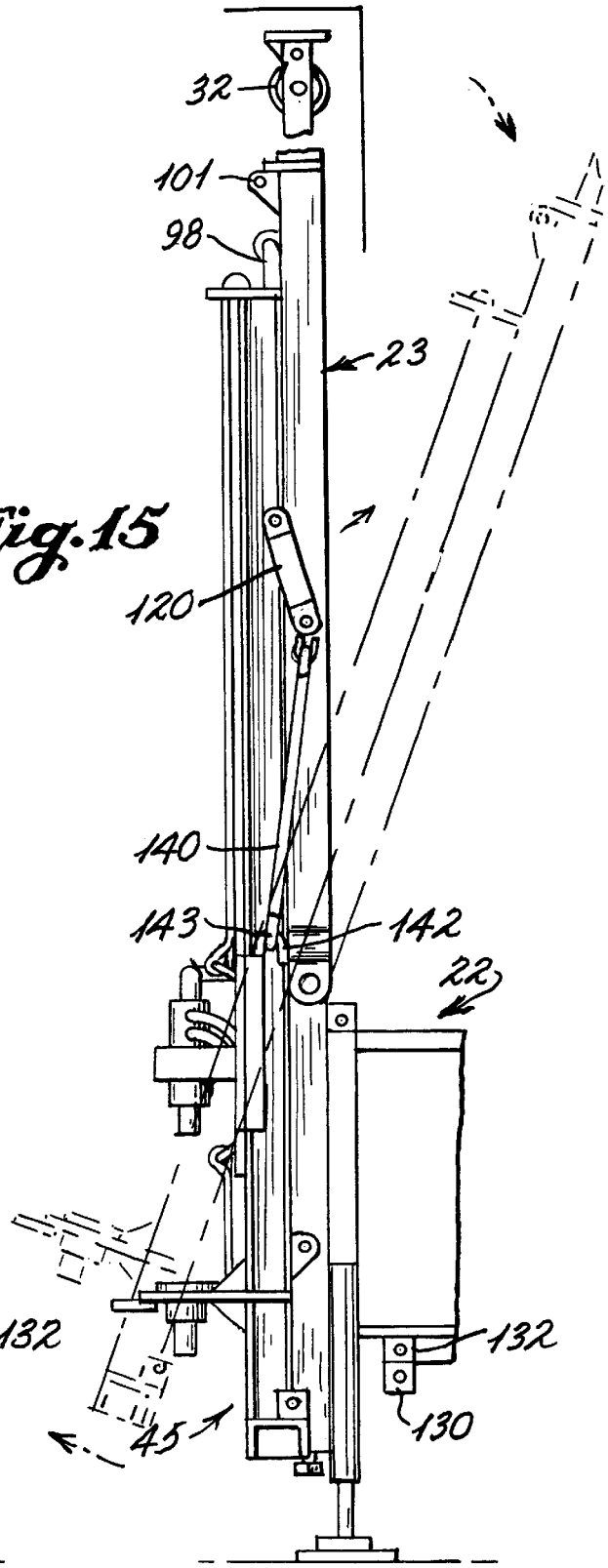
FIG. 15 is a further illustrational view showing the present invention in a stored or transport position and prior to lowering as illustrated in dotted line in the drawing figure toward the transport position of FIG. 10.

When it is desirable to remove the rotary drive head and utilize the cable drilling or hoist elements associated with the cable rig, the present invention provides a unique manner for utilizing the control device 75 for elevating the assembly from the deployed position of FIG. 13 to an upper stored position, as shown in FIG. 15.

In this respect, the present invention provides at least one, and preferably two, restraint elements 140 which extend from lower ends secured about hooks 142 provided on the holding plate 44. As shown, the hooks 142 extend from the rear surface of the holding plate on opposite sides thereof. The restraint elements may be formed from chains or heavy cable having looped outer ends 143 for fitting over the hooks 142. The opposite ends thereof extend to supports 150 secured on opposite sides of the derrick.

With specific FIG. 14, the top head rotary drive and mast assemble 10 is shown as being oriented in a position for drilling relative to the derrick 23. With the restraint elements 140 in place, the control device or hydraulic cylinder 75 is operated so as to lower the holding plate 44 and thus the top head rotary drive 40 downwardly toward the guide table 48. The restraint elements 140 will limit the degree of downward movement of the holding plate and prevent movement at a given point. Thereafter, the operation of the control device to lower the holding plate will act to actually raise the mast because of the movement of the cables extending between the control device and the holding plate. As the mast elevates, it will pivot about the support arms 120 until it comes into abutting relationship with respect to the derrick, as shown in FIG. 11. As the mast is raised relative to the holding plate the restraining elements 140 will remain taut. The mast will be held in the raised position by the action of the hydraulic system associated with the control device thus insuring that the mast will be retained in the raised position.

To deploy the mast from the raised position and with specific reference to FIGS. 11–13, with the mast against the derrick, the control device 75 is operated to raise the holding plate as indicated by the arrows in FIG. 12. As this occurs, the mast will begin to fall under its own weight toward the ground being stabilized by the support arms 120. Lateral movement of the mast is limited by the safety line or chain 100. To control and limit swinging motion of the mast, a guide cable or chain 101 is connected between bracket 102 and 103 secured to the mast and derrick, respectively, at a distance slightly above the guide table. The guide cable as shown is generally not greater than approximately 39 inches in length to permit the necessary deployment of the mast. With the mast positioned slightly above the ground, the cable 33 of the drill rig may be connected to the connector extending from the guide table and slightly elevated thereby taking the full weight of the mast essentially off of the support arms. Thereafter, the mast may be pulled outwardly to its full extent and lowered to the position shown in FIG. 13. During this motion, the restraint elements 140 will automatically drop free of the hooks on the holding plate to a position shown in FIG. 13 and will thus not be in a position to restrict the downward movement of the holding plate so that the top head rotary drive may be utilized in its capacity for drilling purposes. Thereby, the restraint elements are automatically disconnected from the top head rotary drive and mast assembly during the deployment of the mast relative to the derrick.

In view of the foregoing, the present invention provides a top head rotary drive and mast assembly which may be easily connected to and deployed relative to a derrick of a conventional cable or other drill rig such that the mast may be moved to an appropriate drilling position utilizing the top head drive for movement of a drill string. Thereafter the top head rotary drive can easily be disconnected from the drill string and the mast raised utilizing the control device associated with the holding plate. The mast is lifting toward the derrick and positively retained in the raised out-of-way position so that the conventional cable equipment and cable lines of the drill rig may be used to support or otherwise work with the drill string or can be used to drill or drive well casing in a conventional manner.

As opposed to using the control device 75 for elevating and lowering the mast described above with respect to the preferred embodiment, other devices may be used to lower and raise the mast to and from it's deployed position. In this respect, and as shown in dotted line on FIG. 12, a hydraulic or electric winch 145 may be mounted to the derrick and includes a cable 146 secured to the mast, such as to the bail 98 at the crown of the mast. Appropriate controls, not shown, could be used to raise and lower the mast using the winch.

Figure 10:
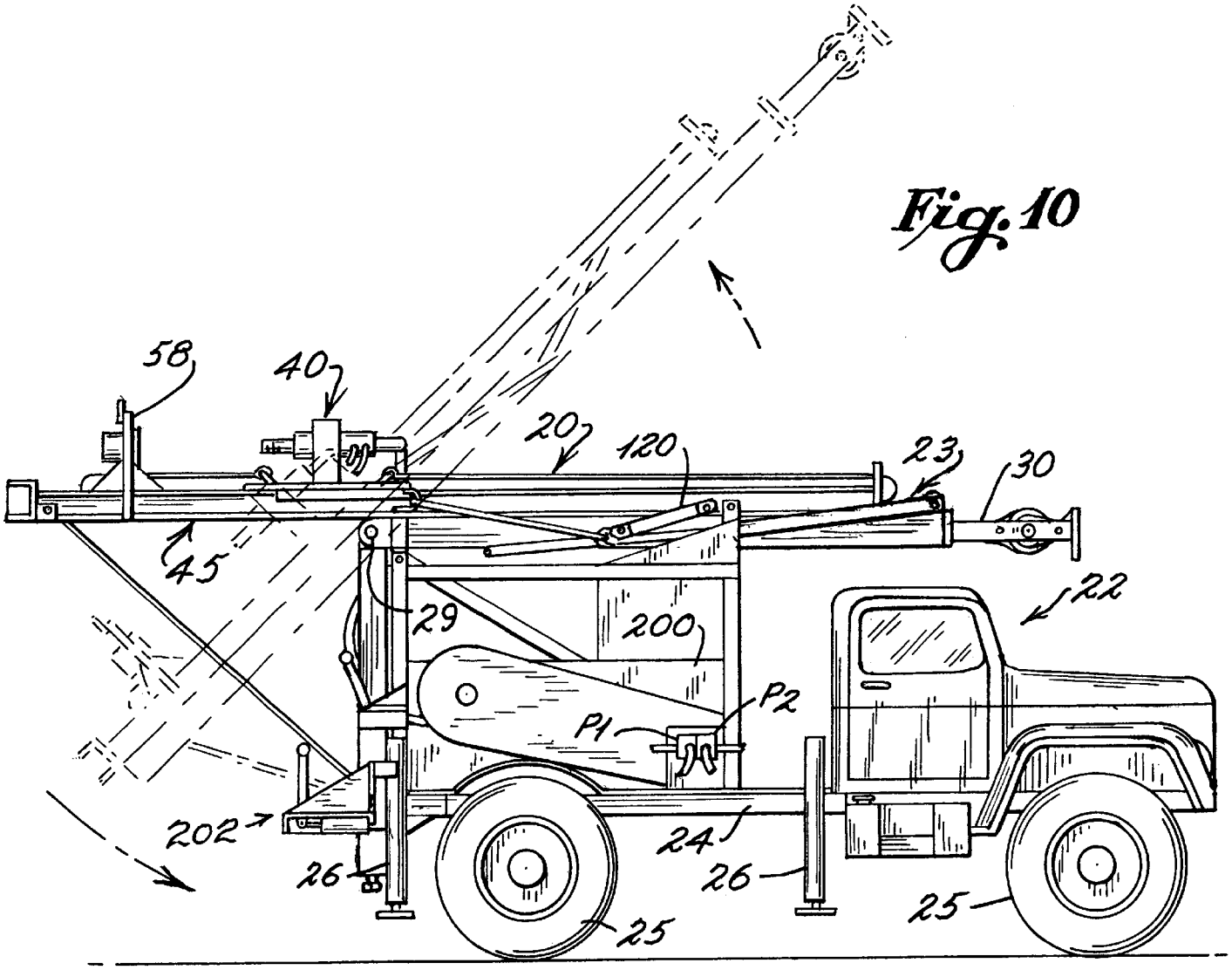
FIG. 10 is an illustrational view of the assembly of the present invention as mounted in a transport position in horizontal relationship over the chassis of a conventional cable drill rig.

As previously discussed, the motors 43A and 43B for driving the top head rotary drive 40, the control device in the form of a hydraulic cylinder 75 and the holding wrench 66 are preferably controlled by hydraulic fluid. To convert the cable rig to provide the necessary source of fluid power, a double pump P1 and P2 is directly mounted to a drive shaft (not shown) of a diesel or gas engine 200 mounted on the chassis of the rig, as shown in FIG. 10 and with reference to the hydraulic circuit shown in FIG. 16. The pumps P1 and P2 are connected to a control panel 202 mounted at the rear of the rig as shown in FIGS. 5 and 10. The pumps are connected to a 50 gallon source of hydraulic oil 204 shown in the fluid circuit FIG. 16. The reservoir is mounted on the opposite side of the rig from the pumps shown in FIG. 10 and, therefore, is not depicted in the drawings.

Pump P2 is connected through a first branch of the hydraulic fluid circuit 205 and through a pressure compensated flow control valve 206 to manual control valves 207 and 208 which are controlled by levers 209 and 210, respectively. The valves 207 and 208 are used to control the operation of the hydraulic motors 43A and 44B of the top head rotator 40. A pressure release valve 212 is shown as being mounted between the valves 207 and 208 and the pressure compensated of flow control valve 206. The fluid circuit 205 is controlled by the control valve 206 and is used to provide maximum drilling speed and torque to the motors 43A and 43B.

Pump P1 is shown as being connected in a second branch of the hydraulic fluid circuit 220 and through a pressure relief valve 222 to a flow diverter valve 224 which is manually controlled by a lever 225. In a first position of the diverter valve 224, hydraulic fluid is provided to a sub-circuit 226 to a series manually operable valves 227, 228, 229 and 230 each of which is manually controlled by operating levers 231, 232, 233 and 234, respectively. Each of the valves 227–230 is connected in a fluid circuit to control the deployment and retraction of the hydraulic stabilizing cylinders 26 which are mounted on the cable rig and which are utilized to stabilize the rig during drilling By manually switching the diverter valve 224 to a second position, hydraulic fluid is provided to sub-circuits 240A and 240B by way of which hydraulic fluid is provided in sub-circuit 204A through a pressure relief valve 242 to a series of manually control valves 244, 245, 246, and 247 which are controlled utilizing the manual levers 231, 233, and 234 respectively. Valve 234 is used to control the operation of the control device or the hydraulic cylinder 75 whereas valve 245 is utilized to control the operation of the holding wrench 66. Valve 246 is connected to operate an air valve cylinder 250 which provides high pressure air through the rotator head for purposes of providing high pressure air to a drill string. Valve 247 is connected through a control valve 248 which is connected to a source of water 252. The water is provided for drilling purposes and a hose 255 is connected to the rotator head in order to introduce water through the drill string when required. Sub-circuit 240B is shown as being connected to the top head rotary drive motors 43A and 43B through control valve 208. Hydraulic fluid is supplied at normal operating pressure through this sub-circuit to the motors 43A and 43B.

During operation of the control device or feed cylinder 75, the amount of pressure, referenced as a hold-down pressure, is regulated by the hold-down valve 242 and a second hold-down valve 260. These valves control the amount of pressure in the hydraulic circuit.

To obtain maximum pressure for drilling speed and torque at motors 43A and 43B, the diverter valve 224 is manually moved to a third intermediate position such that hydraulic fluid is recycled to the $P_2$ through line 260 from which the fluid is directed to the valves 209 and 210 controlling the top head drive motors 43A and 43B.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

I claim:

1. An apparatus for adapting a vehicle having a derrick to be used with a top head rotary drive, the apparatus including a mast, a holding plate, a top head rotary drive mounted to said holding plate, a top head rotary drive raising and lowering control device mounted to said mast, connecting means for connecting said control device to said holding plate so that said holding plate is selectively movable along said mast, a guide table mounted to a lower portion of said mast, at least one upper support arm pivotally secured to said mast in space relationship above said guide table and having an outer end adapted to be pivotally secured to the derrick, at least one upwardly inclined stabilizing arm having a first end mounted to a lower portion of said mast and an outer end adapted to be connected relative to the vehicle, another stabilizer arm connected to said lower portion of said mast in spaced relationship to said at least one inclined stabilizer arm and having an outer end adapted to be connected relative to the vehicle, and means for permitting the raising of said mast from a deployed position spaced from the derrick to a stored position adjacent the derrick.

2. The apparatus of claim 1 in which said means for permitting the raising of said mast includes restraint means adapted for selectively connecting said holding plate to the derrick for selectively restraining movement of said holding plate along said mast and toward said guide table so that force applied by said control device to urge said holding plate toward said guide table may be used to lift said mast relative to the derrick when said at least one upper support arm and said restraint means are connected between said mast and the derrick.

3. The apparatus of claim 2 in which said restraint means includes a pair of hook members mounted to said holding plate and a pair of generally parallel upwardly inclined elements extending from one end adapted to be mounted to said hook members to opposite ends adapted to be secured to the derrick.

4. The apparatus of claim 2 in which said outer end of said another stabilizer arm is adapted to be connected to the vehicle such that said another stabilizer arm extends at an angle between said mast and the drilling rig which differs from an angle of inclination of said at least one inclined stabilizer arm.

5. The apparatus of claim 1 in which said means for raising said mast includes a winch means spaced from said mast and means for operatively connecting said winch means to said mast.

6. The apparatus of claim 1 including a pair of upper support arms pivotally mounted in generally parallel relationship to said mast.

7. The apparatus of claim 6 including a pair of generally parallel inclined stabilizer arms mounted to said lower portion of said mast.

8. The apparatus of claim 7 in which said outer end of said another stabilizer arm is adapted to be connected to the vehicle such that said another stabilizer arm extends at an angle between said mast and the drilling rig which differs from an angle of inclination of said at least one inclined stabilizer arm.

9. The apparatus of claim 1 wherein said guide table includes a guide opening therethrough, and a section of said guide table being moveably mounted so as to permit lateral access to said opening.

10. The apparatus of claim 1 wherein said connecting means includes an upper rotary guide mounted along said upper portion of said mast and a lower rotary guide mounted along an lower portion of said mast, a first cable-like element extending from said control device over said upper rotary guide to a first end which is connected to said holding plate, and a second cable-like element extending from said control device beneath said lower rotary guide to a second end connected to said holding plate.

11. The apparatus of claim 10 in which said control device is a hydraulic cylinder having an extension rod carrying a double pulley, each of said first and second cable-like elements extending about said double pulley to said second ends secured to said mast.

12. The apparatus of claim 1 including a pump adapted to be connected to a power supply and being adapted to be connected to a source of hydraulic fluid, said control device including a hydraulic device having an extendable rod associated therewith, a hydraulic circuit connected between hydraulic cylinder and said pump, and valve means for controlling the flow of hydraulic fluid to said hydraulic cylinder.

13. The apparatus of claim 12 in which said top head rotary drive includes at least one hydraulic motor, a first branch of said hydraulic circuit connected between said at least one hydraulic motor and said pump, and valve means for controlling the flow of hydraulic fluid through said first branch to said at least one hydraulic motor.

14. The apparatus of claim 13 including a holding wrench pivotally mounted to said lower portion of said mast, said holding wrench being operable by hydraulic pressure, a second branch of said hydraulic circuit connected between said holding wrench and said pump, and a control valve mounted in said second branch to control the flow of hydraulic fluid to said holding wrench.

15. A combination drilling rig and top head rotary drive and mast assembly which includes a cable drilling rig having a derrick having an upper end over which drill cables selectively extend, a mast, a holding plate slidably mounted to said mast, a top head rotary drive mounted to said holding plate, a top head rotary drive raising and lowering control device mounted to said mast, connecting means for connecting said control device to said holding plate so that said holding plate is selectively movable along said mast, a guide table mounted to the lower portion of said mast, at least one upper support arm pivotally secured to said mast in spaced relationship above said guide table having an outer end pivotally connected to said derrick, and restraint means mounted to said derrick and being selectively connected to said holding plate for selectively restraining movement of said holding plate along said mast such that a force applied by said control device to urge said holding plate toward said guide table when said restraint device is connected to said holding plate is used to lift said mast relative to said derrick.

16. The combination of claim 15 including at least one inclined stabilizer arm having a first end selectively connected to a lower portion of said mast and a second end selectively connected to the drilling rig, a second stabilizer arm mounted to said lower portion of said mast in vertically spaced relationship with respect to said at least one first stabilizer arm and having an outer end adapted to be selectively connected to said drilling rig.

17. The combination of claim 16 including a pair of generally parallel upper support arms pivotally connected between said mast and said derrick and a pair of inclined stabilizer arms selectively connectable between a lower portion of said mast and said cable drilling rig.

18. The combination of claim 17 including means from mounting said second stabilizer arm generally perpendicular with respect to said mast and said drilling rig.

19. The combination of claim 15 in which said restraint means includes at least one element mounted to said derrick and having an outer free end adapted to selectively engage at least one hook extending from said holding plate.

20. The combination of claim 15 in which said control device includes a hydraulic cylinder having an extensible rod, means for connecting said extensible rod to a first element which extends from a point of connection on said mast to a point of connection on said holding plate and a second element extending therefrom and between a point of connection on said mast to a second point of connection on said holding plate, a source of hydraulic fluid, a motor mounted on said drilling rig, a pump drivingly connected to said motor, a hydraulic circuit extending from said pump to said hydraulic cylinder and valve means mounted within said hydraulic circuit for controlling the operation of said hydraulic cylinder.

21. The combination of claim 15 in which said top head rotary drive includes at least one hydraulic motor, a source of hydraulic fluid, a pump, a hydraulic circuit mounted to said drilling rig between said at least one motor and said pump, and at least one valve mounted within said hydraulic circuit for controlling operation of said at least one hydraulic motor.

22. The combination of claim 15 including a hydraulic holding wrench mounted to said lower portion of said mast, a source of hydraulic fluid, a pump, a hydraulic circuit mounted between said holding wrench and said pump and a valve mounted in said hydraulic circuit for controlling operation of said holding wrench.

* * * * *